US006068245A

United States Patent [19]

Roper

[11] Patent Number: 6,068,245

[45] Date of Patent: May 30, 2000

[54] APPARATUS AND METHOD FOR CUSHIONING THE ACTION OF DRAW DIES OPERATING IN A STAMPING PRESS AND THE LIKE

[76] Inventor: Ralph Roper, 2930 Somerset Bay, Indianapolis, Ind. 46240

[21] Appl. No.: 09/154,132

[22] Filed: Sep. 16, 1998

[51] Int. Cl.[7] ..... F16F 9/14; F16F 5/00

[52] U.S. Cl. ..... 267/64.15; 267/119

[58] Field of Search ..... 91/4 R, 4 A, 405, 91/406; 267/64.15, 75, 119, 130, 113, 118

[56] References Cited

U.S. PATENT DOCUMENTS

| | | | |
|---|---|---|---|
| 1,664,486 | 4/1928 | Rode | 267/119 |
| 1,805,521 | 5/1931 | Hansen | 91/4 R |
| 2,976,845 | 3/1961 | Goldring | 60/560 |
| 3,326,546 | 6/1967 | Otto | 267/64.15 |
| 3,589,702 | 6/1971 | Spieth et al. | 367/64.15 |
| 3,869,861 | 3/1975 | Case | 267/64.11 X |
| 4,153,237 | 5/1979 | Supalla | 267/64.15 |
| 4,428,566 | 1/1984 | de Baan et al. | 267/64.15 |
| 4,445,671 | 5/1984 | Reuschenbach et al. | 267/64.15 X |
| 4,601,461 | 7/1986 | Brough et al. | 267/64.15 |
| 4,628,796 | 12/1986 | Wallis | 267/119 X |
| 4,647,026 | 3/1987 | Siemann et al. | 267/64.15 |
| 5,042,253 | 8/1991 | Kataoka | 91/4 R X |

*Primary Examiner*—John E. Ryznic
*Attorney, Agent, or Firm*—Woodard, Emhardt, Naughton, Moriarty & McNett, Patent and Trademark Attorneys

[57] ABSTRACT

A draw die operable within a straightside press includes a lower die shoe with a lower die; pressurized lift cylinders each having an upwardly extending piston rod and an axial resistance to compression; a generally ring-shaped cushion defining a central hole and a plurality of lock beads extending upwardly in spaced-apart relation surrounding the central hole, wherein the cushion surrounds the punch, is sized and configured to support a blank atop the beads and over the punch for draw forming the blank over the punch, and is supported by the lift cylinders; a plurality of cushion units held by the shoe and each having an upwardly extending piston rod and an axial resistance to compression; an upper die defining a second stamping shape which mates with the first stamping shape; a plurality of hydraulic shock absorbers held by the upper die and having an axial resistance to compression and a piston rod that extends downwardly toward the cushion. A ram mechanism moves the upper die downwardly where the shock absorbers engage the cushion and accelerate it downwardly, depressing the lift cylinders somewhat. Upon further downward movement of the upper die and cushion, the cushion cylinders become engaged and offer sufficient resistance as they are depressed to bind a blank between upper die and cushion and to draw form the blank between the two dies. After reaching the bottom of the stroke, the upper die retracts upwardly, along with the cushion lifted by the lift cylinders, but the pistons rods of the self-contained cushion units are delayed in their upward return by an internal valving system.

37 Claims, 8 Drawing Sheets

APPARATUS AND METHOD FOR CUSHIONING THE ACTION OF DRAW DIES OPERATING IN A STAMPING PRESS AND THE LIKE

FIELD OF THE INVENTION

The present invention relates to the field of stamping presses, and specifically to an apparatus and method for cushioning the action of draw dies operating in stamping presses and the like.

BACKGROUND OF THE INVENTION

For many years, double action or "toggle" presses were the industry standard for forming large metal parts such as automobile hoods. A toggle press has an outer ram that comes down and binds the blank to be formed. An inner ram with a punch having the desired part shape then follows through to draw the blank into a complementary shaped die cavity. In the quest for speed and efficiency, much of the industry is now using straightside or transfer presses which is the forming press to form the initial shape from the flat metal blank. Next, the part passes through a series of individual stations or presses to complete the necessary die operations, all in one combination process. Unfortunately, toggle presses are relatively slow and form the part in an inverted or upside down orientation. In most cases then, the toggle press will most likely have to include a turnover station following the draw operation. A solution to the speed and inversion problem is the use of the straightside press. Unlike the toggle press, where the outer ram comes down gently to bind the blank for drawing. Straightside presses have but a single ram with an upper die or binder that is actuated by the throw of the press crank cycling at up to 30 strokes per minute and at up to 30 inch strokes. The die cushion or lower binder surrounds a lower punch which defines the complementary part shape to the cavity of the upper die. The cushion floats around the punch and is supported in an up position upon a series of gas springs that collectively offer adequate force to bind the blank for the draw operation. When the upper die binder face meets the floating cushion and blank, the blank is instantly contained between the upper and lower binder faces. The impact between the ram and cushion at this instant is tremendous and is the result of the fast moving ram contacting the stationary cushion. The shock caused by this impact causes great damage to the press drive and creates undesirable pressure spikes in the individual cushion unit seals. After contact, because the ram force exceeds the resistance force of the gas cylinders, the ram, blank and cushion continue downward at the automatic press cycle speed until the they reach the bottom of the stroke, at which point the blank has been formed to the desired shape. At this point, the cushion cylinders have been compressed, and their resistive force has increased in accordance with the compression ratio of the nitrogen gas (Boyle's law). Cushion forces for major automotive dies commonly operate in the range of 200 to 300 tons. When the press ram reaches bottom position and starts its upstroke, the nitrogen gas cushion springs with their intensified pressure forces against the upper die throughout the die cushion upstroke. These forces cause major press drive damage, and stamping facilities have long been seeking a method to unload the cushion forces at the bottom of the press stroke so the cushion forces do not follow through causing such damage. Thus, while gains have been made in speed and efficiency form the use of straightside presses versus toggle presses, the wear and tear inherent in the application of straightside presses continues to plague its users.

What is needed is a way to abate or eliminate the wear and tear resulting from the high impact and recoil effect inherent in straightside presses using nitrogen spring-loaded die cushions and to delay the die cushion "up" force such that the primary cushion force will not follow the press ram "up" stroke.

SUMMARY OF THE INVENTION

Generally speaking, apparatus is provided for cushioning the action of draw dies operating in a straightside stamping press. The apparatus includes a shock absorber for overcoming the inertial impact between the ram driven upper die shoe and the motionless cushion surrounding the forming punch. The apparatus also includes a delayed return cushion unit that provides the cushion with high tonnage resistance to movement when the ram slams into the cushion, thereby enabling proper binding of the blank, but conversely permits the ram to return to its upper position without the added tonnage of the resistance cushion units following it back up. The apparatus further includes assembly and use of the shock absorbers, cushion units, and other press components to maximize the operation of the press while minimizing the attendant wear and tear thereon.

A draw die operable within a straightside press includes a lower die shoe with a lower die; pressurized lift cylinders each having an upwardly extending piston rod and an axial resistance to compression; a generally ring-shaped cushion defining a central hole and a plurality of lock beads extending upwardly in spaced-apart relation surrounding the central hole, wherein the cushion surrounds the punch, is sized and configured to support a blank atop the beads and over the punch for draw forming the blank over the punch, and is supported by the lift cylinders; a plurality of cushion units held by the shoe and each having an upwardly extending piston rod and an axial resistance to compression; an upper die defining a second stamping shape which mates with the first stamping shape; a plurality of hydraulic shock absorbers held by the upper die and having an axial resistance to compression and a piston rod that extends downwardly toward the cushion. A ram mechanism moves the upper die downwardly where the shock absorbers engage the cushion and accelerate it downwardly, depressing the lift cylinders somewhat. Upon further downward movement of the upper die and cushion, the cushion cylinders become engaged and offer sufficient resistance as they are depressed to bind a blank between upper die and cushion and to draw form the blank between the two dies. After reaching the bottom of the stroke, the upper die retracts upwardly, along with the cushion lifted by the lift cylinders, but the pistons rods of the self-contained cushion units are delayed in their upward return by an internal valving system.

The delayed return cushion units each include an outer tube having an inner diameter; a base plate disposed at the bottom of the cylinder; an annular-shaped head plate disposed at the top of the cylinder and having an inner cylindrically-shaped wall; an inner tube having in outer diameter and in inner diameter and mounted to extend between the head plate and the base plate coaxially within the outer tube; an annular-shaped outer piston coaxially mounted between the inner and outer pistons to reciprocate between the head plate and the base plate; an inner piston/rod coaxially mounted in the inner tube to reciprocate vertically therein between a retracted, compressed position and an extended, rest position, the rest position including the piston/rod extending through the inner cylindrically-shaped wall of the head plate and upwardly of the head plate; wherein the outer tube, base plate, head plate, inner tube, outer piston and inner piston define: a gas chamber bounded by the outer tube, inner tube, head plate and outer piston, an outer hydraulic chamber bounded by the outer tube, inner tube, base plate and outer piston, and in inner hydraulic chamber bounded by the inner tube, base plate and inner piston; seal means for preventing leakage of gas from the gas chamber and hydraulic fluid from the hydraulic fluid chambers; passageway means providing communication between the outer hydraulic chamber and the inner hydraulic chamber and including a check valve permitting substantially unrestricted fluid flow from the inner hydraulic chamber to the outer hydraulic chamber, but severely restricting fluid flow from the outer hydraulic chamber to the inner hydraulic chamber; gas in the gas chamber having a pressure greater than ambient pressure; hydraulic fluid disposed in the inner and outer hydraulic chambers; and, means for retaining the head plate, base plate, inner tube, out piston and inner piston contained substantially entirely within the outer tube.

It is an object of the present invention to provide an improved stamping draw press operation.

It is another object of the present invention to provide apparatus for stamping presses that will abate the impact of the die against the motionless cushion.

It is a further object of the present invention to provide apparatus for stamping presses that will abate the recoil force exerted on the cushion and ram mechanics on the upstroke of the press cycle.

Further objects and advantages will become apparent from the following description of the preferred embodiment.

DESCRIPTION OF THE PREFERRED EMBODIMENT

Figure 1:
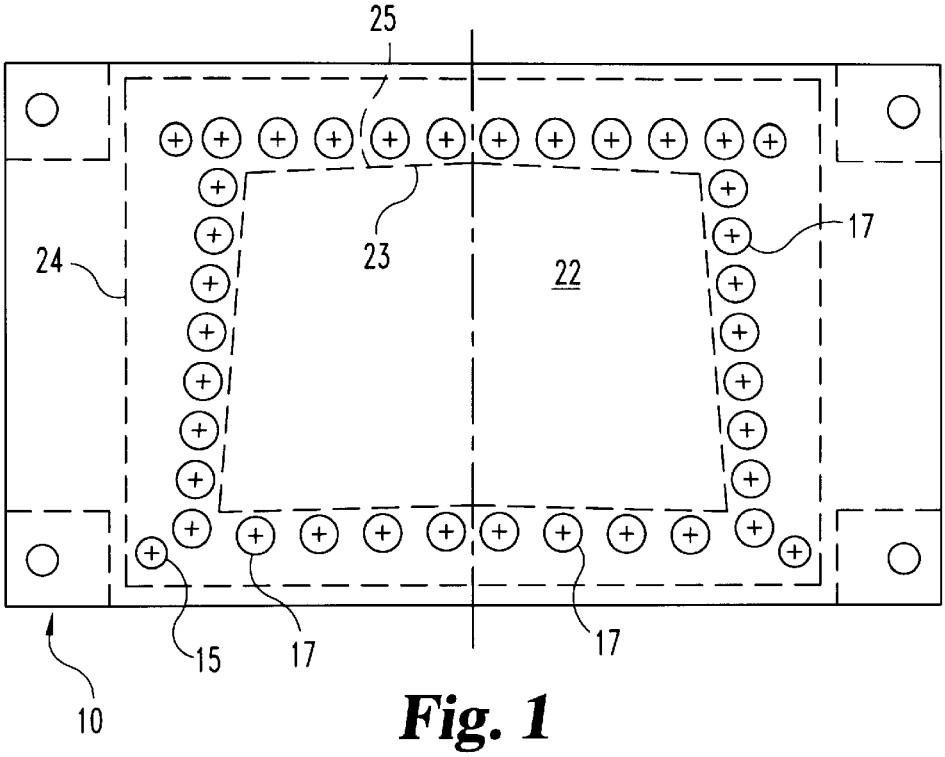
FIG. 1 is a plan, diagramatic view of a draw die 10 equipped with apparatus for cushioning the action of the die in accordance with the preferred embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, and that any alterations or modifications in the illustrated device, and any further applications of the principles of the invention as illustrated therein are contemplated as would normally occur to one skilled in the art to which the invention relates.

Figure 2:
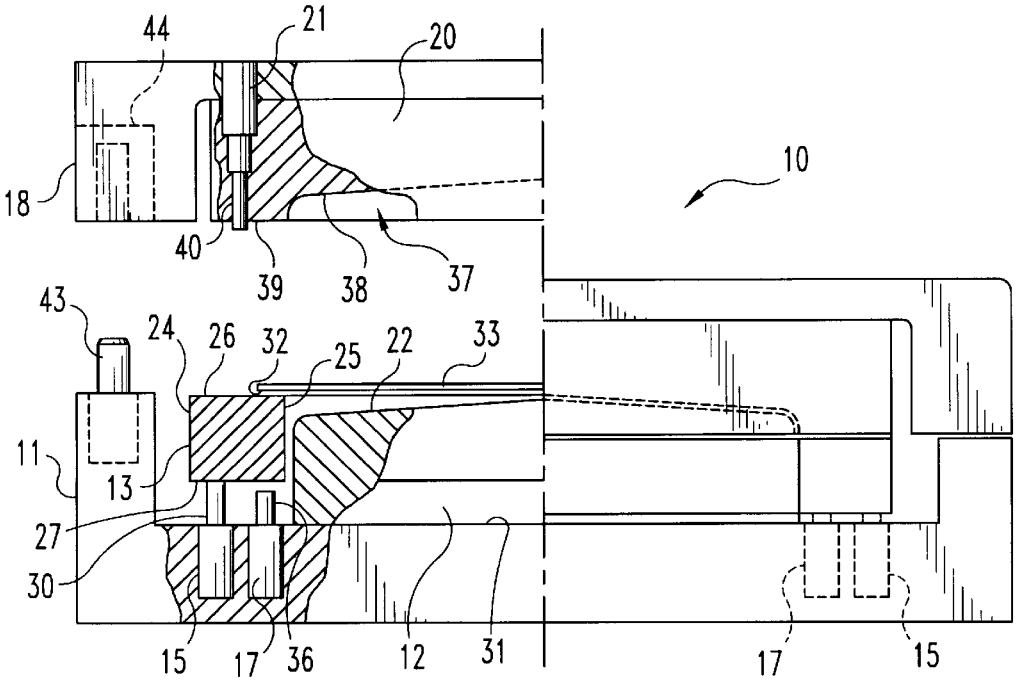
FIG. 2 is a side, elevational view, of a draw die 10 equipped with apparatus for cushioning the action of the die in accordance with the preferred embodiment of the present invention, and with portions thereof broken out in cross-section for clarity, and showing the die 10 in both open and closed positions.

Referring now to FIGS. 1 and 2, there is shown a draw die operable within a straightside press 10 equipped with apparatus for cushioning the action of the die in accordance with the preferred embodiment of the present invention. Die 10 generally includes a lower die shoe 11, a punch 12, a pad or "cushion" 13, a set of four (4) lift cylinders 15, a plurality of delayed return cushion units 17, an upper die shoe 18, upper die 20, and a set of hydraulic shock absorbers 21. As with other presses of this type, punch 12 is fixedly mounted to lower shoe 11 and has a top surface 22 which defines the desired shape of the part to be formed. For purposes of discussion of the current embodiment, and as seen by the plan view outline 23 of punch 12 (FIG. 1), the part intended to be formed by die 10 is an automobile hood. The present invention is not intended to be limited to the formation of hoods, or of auto parts. Further, the present invention and its components are contemplated to have applications outside of the stamping industry.

Cushion 13 is a ring that encircles punch 12 and has an outer surface 24, an inner surface 25, an upper surface 26 and a lower surface 27. Cushion 13 thus defines a central hole that is bounded by inner surface 25 and through which extends punch 12. The outer profile of cushion 13, in overall plan view, is rectangular, as shown by the outline of outer surface 24 (FIG. 1) and the inner profile defined by inner surface 25 in plan view has the same shape as the plan view shape (at 23) of punch 13. Upper and lower surfaces 26 and 27 are parallel to each other and orthogonal to outer and inner surfaces 24 and 25. Cushion 13 is thus sized to reciprocate vertically around punch 12, but is held floating in the up and rest position (as seen in the left half of FIG. 2) by the lift cylinders 15. There are four lift cylinders 15, one at each corner, mounted in cavities in lower shoe 11. Each cylinder 15 is a standard, three ton nitrogen gas cylinder with a piston rod 30 that may reciprocate between a retracted, compressed position and an extended, rest position. In the rest position, piston rod 30 extends about 7 inches from the floor 31 of lower shoe 11. In its compressed position (right half of FIG. 2), piston rod 30 is flush or extends just slightly above floor 31. Numerical values for dimensions, weights, pressures and other characteristics are used herein for purposes of describing one proposed embodiment. It should be understood that such values will vary with the type and size of the part to be formed and with the desired operating characteristics of the corresponding press.

A plurality of lock beads or draw beads 32 for binding a blank 33 extend upwardly from upper surface 28, proximal to inner surface 25, and thus surround punch 12. Lift cylinders 15 are sized so that, in the rest position, piston rods 30 support cushion 13 high enough so that its upper surface 26 is approximately one inch above the highest point on punch 12. That is, in the rest position, a blank 33 may be positioned over punch 12 and supported around its periphery by beads 13 of cushion 13, as shown in the left side of FIG. 2. Depending on the size of the blank and on the profile of the punch, blank 33 will not touch punch 12 in this rest position, prior to the descent of the upper die 20.

The plurality of delayed return cushion units 17 sit within cavities in lower die shoe 11 in a spaced relationship around punch 12 and under cushion 13. In the present embodiment, there are 34 cushion units 17. As will be described, each cushion unit 17 has a piston rod 36 that extends upwardly approximately six inches above the floor 31 of lower shoe 11.

Upper die 20 defines a cavity 37 with an inner surface 38 that mates with the top surface 22 of punch 12 to define the shape of the part to be formed. Upper die 20 also defines a lower, planar surface 39 and is mounted to the underside of upper die shoe 18 which is mounted to a ram (not shown) which drives shoe 18 and upper die 20 down against cushion 13 and punch 12 to form the desired part. The set of hydraulic shock absorbers 21 comprises four shock absorbers 21 that are mounted at the corners of upper die shoe 18 and upper die 20, and in substantial alignment over the four lift cylinders 15. As will be described, each shock absorber 21 engages with a plunger or adapter 40 that extends one inch below lower planar surface 39. Lower die shoe 11 has four guide posts 43, one extending upwardly from each of its corners, and upper die shoe has a corresponding bushing 44 at each of its corners, each bushing sized to receive a guide post therein to ensure alignment between upper shoe 18 and lower die shoe 11 when the two are brought together.

Figure 3:
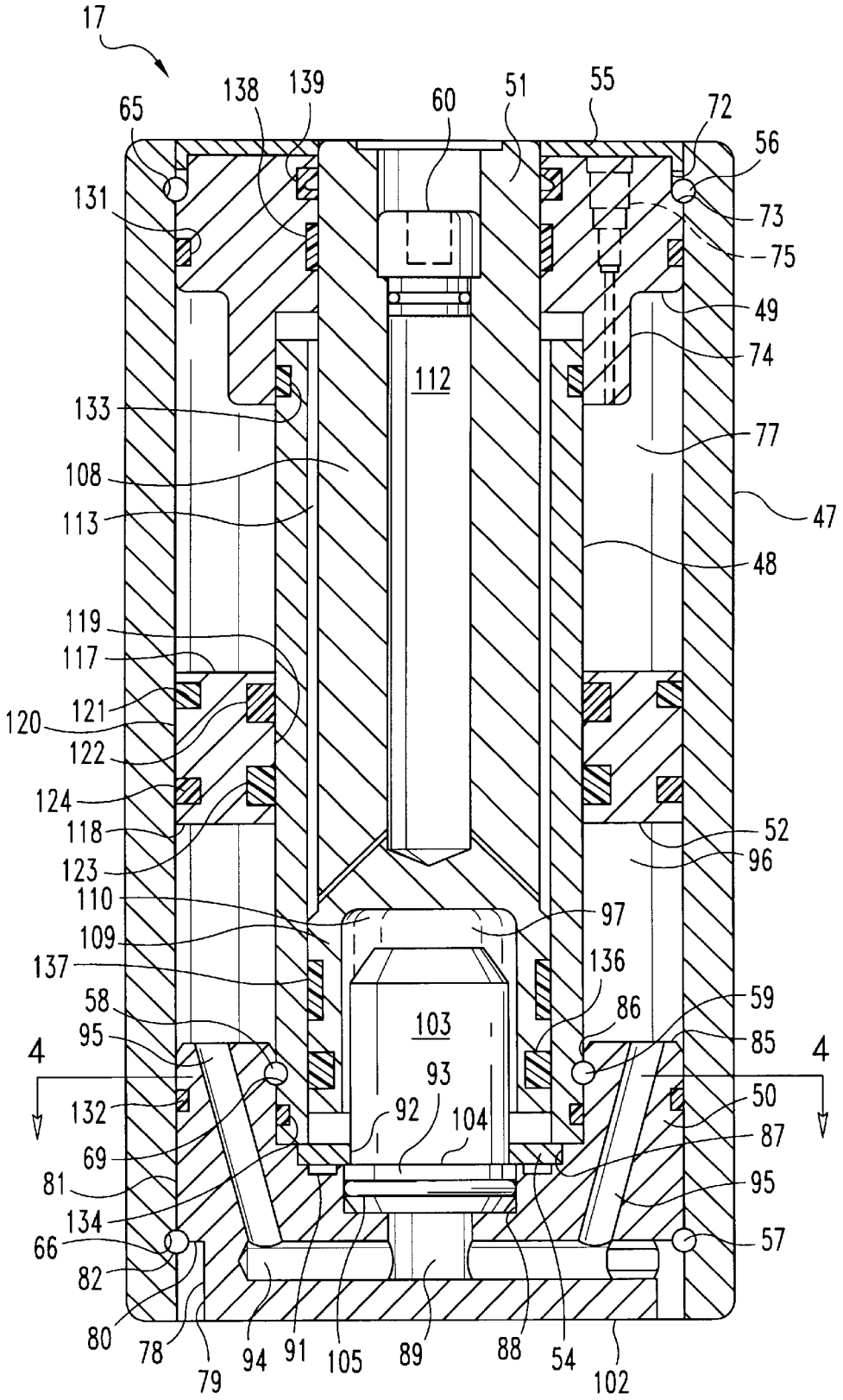
FIG. 3 is side, cross-sectional view of a cushion unit 17 of the die 10 in accordance with the preferred embodiment of the present invention, and shown with piston/rod 51 in the compressed position.
Figure 4:
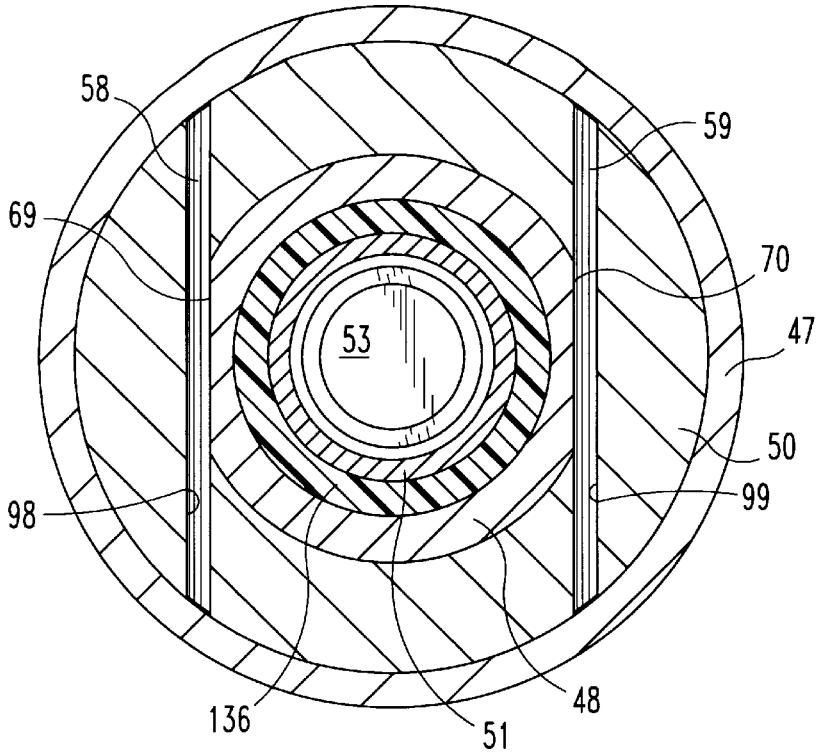
FIG. 4 is a cross-sectional view of cushion unit 17 of FIG. 3 taken along line 4—4 and viewed in the direction of the arrows.
Figure 5:
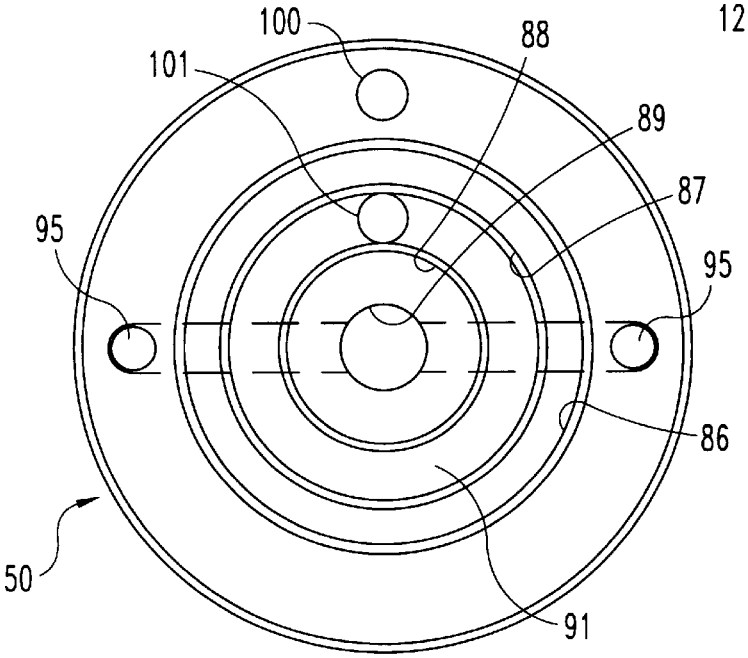
FIG. 5 is a top view base plate 50 of the cushion unit 17 of FIG. 3.

Referring to FIGS. 3 through 5, there is shown a delayed action cushion unit 17 in accordance with the preferred embodiment of the present invention. Cushion unit 17 generally includes an outer tube 47, an inner tube 48, a head plate 49, a base plate, 50, an inner piston and rod combination 51, an outer piston 52, a check valve 53, a disc-shaped check valve retainer 54, and a rod end cover 55, upper and lower lock rings 56 and 57, lock pins 58 and 59, set screw 60, and various seals to be described. Outer tube 47 is cylindrically-shaped and defines upper and lower, inner annular recesses 65 and 66, respectively, that are hemicircular in cross-section. Inner tube 48 is also cylindrical and defines upper and lower annular recesses 67 and 68 for receipt of 0-rings and defines a pair of diametrically opposing, outer transverse recesses 69 and 70 that are arcuate in cross-section and juxtaposed just above lower recess 68. Outer and inner tubes 47 and 48, respectively, are made of hardened tool steel.

Head plate 49 is generally cylindrically-shaped and made of hardened tool steel. It has an outer diameter substantially equal to the inner diameter of outer tube 47 and defines an inner generally cylindrical wall 71 which has an inner diameter substantially equal to the outer diameter of the upper portion of inner piston and rod combination 51. Head plate 49 also defines an upper annular recess 72, the lower portion of which is radiused at 73 to match that of upper lock ring 56 so that lock ring 56 will seat snugly around head plate 49 at the bottom of recess 72, as shown. Head plate 49 defines a cylindrically shaped flange 74 extending downwardly therefrom and having an inner radius substantially equal to the outer radius of inner tube 48. Head plate also includes a fill port 75 for injecting nitrogen gas into the gas chamber 77 of cushion unit 17, as described herein. A valve core (not shown) is provided for insertion into fill port 75 to enable injection of nitrogen gas into gas chamber 77. The valve core may be of any appropriate type that permits injection of pressurized gas from a pressurized gas source. At the lower end of cushion unit 17, base plate 50 is round in cross-section, made of hardened tool steel, and defines a lower annular recess 78 that has a rectangular cross-section to define an outer cylindrically shaped wall 79 and an upper planar and annular shoulder 80. At the intersection of shoulder 80 and the outer cylindrical wall 81 of base plate 50, an annular recess 82 is defined which is radiused to match that of lower lock ring 57 so that lock ring 57 will seat snugly within recess 82, as shown. Base plate 50 has a top surface 85 and defines concentric central recesses 86, 87, 88 and 89, each recess having a generally cylindrical outer wall, and each of recesses 87, 88 and 89 having a diameter that is less than the diameter of the recess above it. The uppermost recess 86 has a diameter substantially equal to the outer radius of inner tube 48. Recess 87 has a diameter substantially equal to that of the outer diameter of disc-shaped check valve retainer 54. Recess 87 includes a planar annular floor 90 which has defined therein a rectangular cross-sectioned, annular recess 91. Recess 88 has a diameter slightly less than the inner diameter (at 92) of retainer 54 and substantially equal to the outer diameter of the lower cylindrical portion 93 of check valve 53. The lowest recess 89 is in communication with a transverse passage 94 which is defined in base plate 50 and is in communication with upwardly angled and diametrically opposed passages 95 which are also defined in base plate 50 and open up through top surface 85 into outer hydraulic chamber 96 of cushion unit 17, as described herein. Base plate also defines a pair of parallel and diametrically opposed holes 98 and 99 (FIG. 4) that are sized and positioned so that, when inner tube 48 is positioned down into top recess 86, outer transverse recesses 69 and 70 align with holes 98 and 99, respectively, and lock pins 58 and 59 may be inserted through holes 98 and 99 to lock inner tube 48 to base plate 50 as shown. Lock pins 58 and 59 are made of hardened drill rod, but the use of other suitable materials in other suitable configurations is also contemplated. Base plate 50 also includes an oil fill port 100 and a vent port 101 which are disposed approximately 90 degrees from passages 95 (FIG. 5). Fill port 100 extends vertically from the bottom surface 102 of base plate 50 and up through top surface 85 and into communication with outer hydraulic chamber 96. Vent port 101 extends vertically from the bottom surface 102 of base plate 50 and opens up into the annular recess 91 defined in floor 90 of recess 87, and thus just below check valve retainer 54. Check valve retainer 54 (FIG. 6) has a generally disc-like shape and defines a hole 125 spaced between midway between it inner and outer cylindrical surfaces 126 and 127. Thus, when check valve retainer 54 is seated within recess 87 and over annular recess 91, vent port 101 is in communication through annular recess 91, up through hole 125 and onto the chamber surrounding check valve 53. As with fill port 75, valve core members of any suitable type (not shown) are provided for insertion into fill and vent ports 100 and 101 to enable injection of oil or other appropriate hydraulic fluid into hydraulic chambers 96 and 97 and to permit venting thereof.

Figure 12:
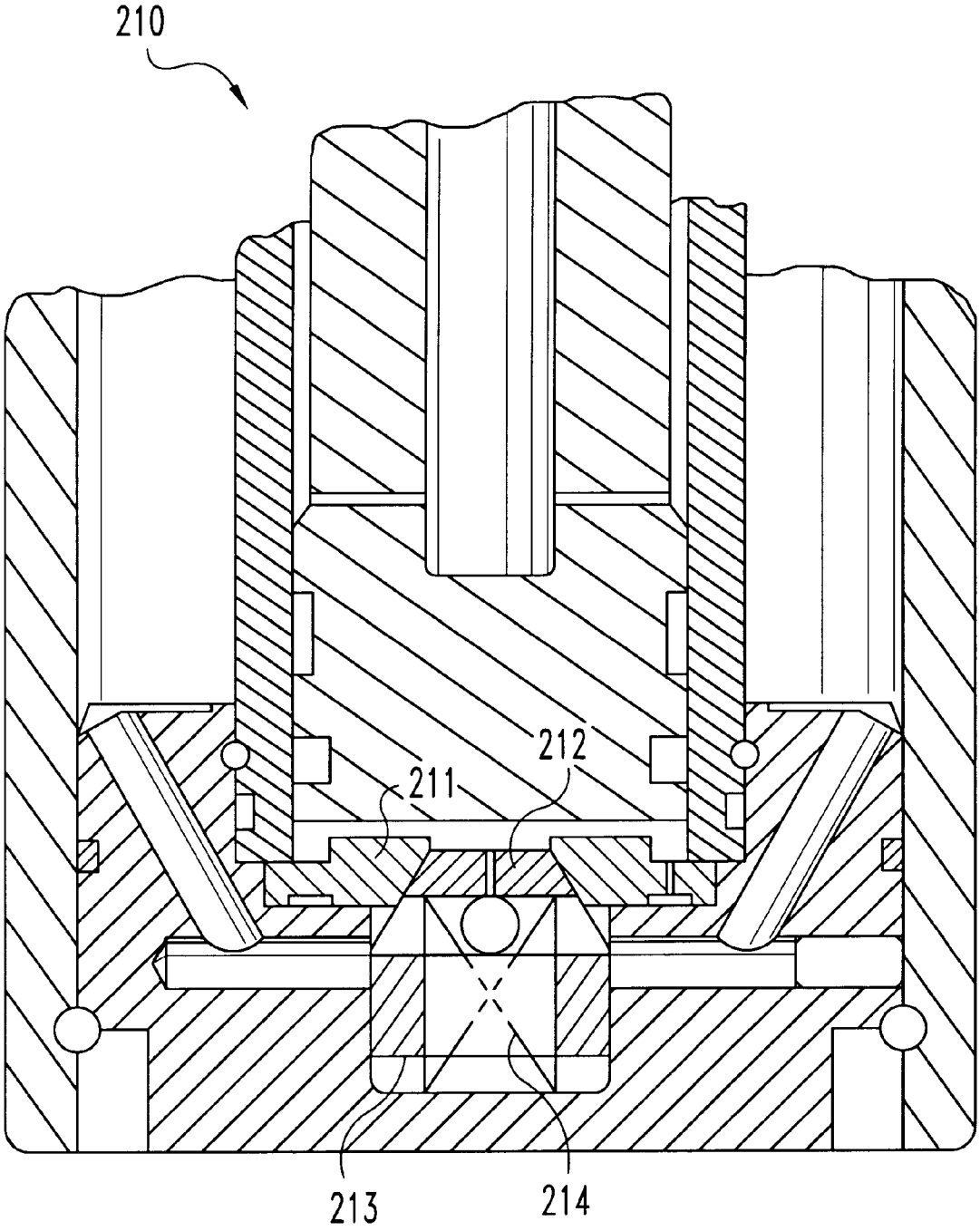
FIG. 12 is a side, cross-sectional view of the lower portion of a cushion unit 210 in accordance with another embodiment of the present invention.

Check valve 53 is preferably a Kepsel brand check valve, model number 2216, commercially available from Kepner Products Company, 995 N. Ellsworth Avenue, Villa Park, Ill. 60181, and oriented to permit free flow in the downward direction, as viewed in FIG. 3. The Kepsel valve 53 has a cone shaped poppet (not shown) with a small orifice therethrough which meters the return flow of oil in the upward direction, as viewed in FIG. 3. Other check valves may be used to achieve a desired flow rate or to satisfy other operating or construction parameters. (One such alternative embodiment is shown in FIG. 12.) Valve 53 has a main cylindrical body 103 and a lower cylindrical body portion 93, the diameter of main body 103 being slightly less than that of lower body portion 93, thereby creating a shoulder 104. Lower body portion 93 also includes an o-ring 105 mounted within an annular recess, as shown.

Piston and rod combination 51 (hereafter referred to as piston/rod 51) is made of hardened tool steel and has an upper piston rod portion 108 and a lower piston portion 109. The outer diameter of piston rod portion 108 is substantially equal to the inner diameter of head plate 49, and the outer diameter of piston portion 109 is substantially equal to the inner diameter of inner tube 48. Piston portion 109 defines a downwardly opening cavity 110 that is sized to be slightly larger than the Kepsel check valve 53 so that piston/rod 51 may translate to the bottom of its stroke and valve 53 will be received within cavity 110, as shown in FIG. 3. Piston rod portion 108 defines a central, upwardly opening cavity 112. Hex-headed set screw 60 has been adapted to screw into the top of cavity 112 as shown and has been provided with an o-ring to effect a fluid-tight seal thereat. The outer diameter of piston rod portion 108 is slightly less than the inner diameter of inner tube 48, thus creating an outer cavity 113, in assembly of cushion unit 17, bounded by piston rod portion 108, inner tube 48, head plate 49 at the top and larger diameter piston portion 109 at the bottom. Central cavity 112 is in fluid communication with outer cavity 113 via four passages 114 that extend outwardly from central cavity 112, as shown.

Outer piston 52 is annular and has a rectangular cross-section at any section thereof as shown in FIG. 3. Piston 52 has top and bottom surfaces 117 and 118, respectively, and has inner and outer cylindrical surfaces 119 and 120, respectively. Annular recesses are defined in inner and outer surfaces 119 and 120, respectively, to receive annular seals 121, 122, 123 and 124. Any suitable seals may be used for seals 121–124 which can operate at temperatures up to 400° F. and should be capable of withstanding a maximum operating pressure of 5000 psi. However, the precise type, brand and characteristics of each seal will vary with the attendant parameters such as the type of fluid to be kept sealed, the operating pressures, the temperatures, and so on. Likewise, the other seals described herein may also be of any suitable type to prevent leakage of the fluid medium from the corresponding chamber under the design parameters of the cushion unit.

Seals are also provided by o-ring 131 between outer tube 47 and head plate 49, by o-ring 132 between outer tube 47 and base plate 50, by o-ring 133 between inner tube 48 and head plate 49, and by o-ring 134 between inner tube 48 and base plate 50. An appropriate seal 136 is provided in an outer recess of piston portion 109 of piston/rod 51 to provide a seal between inner tube 48 and piston portion 109. A wear ring 137 is provided in an outer recess of piston portion 109, between piston portion 109 and inner tube 48, just above seal 136 to keep piston portion 109 centered within inner tube 48 and prevent wear thereto as it reciprocates within inner tube 48. A second wear ring 138 is likewise provided, in a recess in head plate 49, between piston rod portion 108 and head plate 49. And just above wear ring 138, a rod wiper 139 is mounted within a recess in head plate 49 to help keep foreign matter from entering cushion unit 17 along piston/rod 51 as it reciprocates. Cover 55 is generally disc-shaped; is made of molded neoprene rubber; and, is sized to be seated within outer tube 47, around piston/rod 51 and atop head plate 49, as shown.

The dimensions of all mating surfaces of the components of cushion unit 17 are properly fitted per the specifications of the seals.

To assemble cushion unit 17: rod wiper 139, wear ring 138 and o-ring 131 are applied to head plate 49, and head plate 49 is inserted into outer tube 47. Lock ring 56 is then inserted. O-rings 133 and 134 are applied to inner tube 48; seal 136 and wear ring 137 are applied to piston portion 109; seals 121–124 are applied to outer piston 52; suitable valve cores are inserted into base plate 50; and, o-ring 132 is applied to base plate 50. Check valve 53 with its o-ring 105 is seated within recess 88 of base plate 50; check valve retainer 54 is positioned into recess 87 and around check valve 53; and, inner tube 48 is lowered into recess 86 and secured thereat by lock pins 59, as shown. The inner diameter of inner tube 48 is less than the outer diameter of retainer 54 so inner tube 48 holds retainer 54 in place in recess 87, and the inner diameter of retainer 54 is substantially equal to the outer diameter of main body 103 of check valve 53, but is less than the outer diameter of lower portion 93 of check valve 53 so check valve retainer 54 seats against shoulder 104 and holds check valve 53 firmly in place in recess 88. Piston/rod 51 is then inserted into inner tube 48. With the base plate sub-assembly sitting on the assembly table with piston/rod 51 pointing up, the outer tube sub-assembly is slid over the base plate sub-assembly until the outer tube sub-assembly bottoms out to the table. The entire assembly is turned over and lock ring 57 is inserted. At this point, there is a little play in the components, but upon charging the gas chamber, head plate 49 and base plate 50 will be biased axially outwardly, and cushion unit 17 will be fully assembled.

Figure 6:
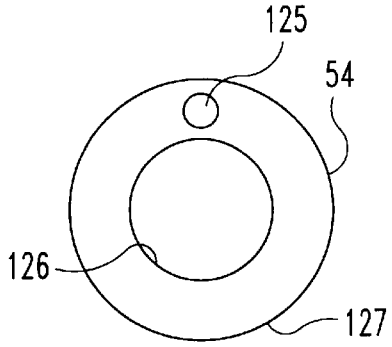
FIG. 6 is a top view of check valve retainer 54 of cushion unit 17 of FIG. 3.

As assembled and shown in FIGS. 3 and 6, cushion unit 17 defines four pressure chambers: gas chamber 77 bounded by outer tube 47, inner tube 48, head plate 49 and outer piston 52; outer hydraulic chamber 96 bounded by outer tube 47, inner tube 48, base plate 50 and outer piston 52; inner hydraulic chamber 97 bounded by piston portion 109, inner tube 48, check valve retainer 54 and Kepsel valve 53; and piston rod gas chamber which includes central cavity 112, and outer cavity 113. Central cavity 112 is provided to enable sufficient volume for the air in outer cavity 113 to compress when piston/rod 51 rises from its compressed position (FIG. 3) to its extended, rest position (FIG. 6). The compression of air therein upon extension of piston/rod 51 is negligible in relation to the other operating pressures of cushion unit 17.

To charge cushion unit 17 with nitrogen and oil, unit 17 is placed in the "rod up" position; a valve core is inserted into fill port 75; a pressurized gas source is connected with fill port 75; and, gas is injected thereat into gas chamber 77 to the desired psi. For purposes of description of the present embodiment, gas chamber 77 is charged to approximately 2000 psi. The gas source is removed, and the fill port is covered with an appropriate o-ring boss (not shown) as a secondary seal. Cushion unit 17 is then turned over and the valve core (not shown) is inserted into fill port 100. A hydraulic fluid adapter (not shown) is then attached to fill port 100 and oil is injected until overflow occurs. Then a valve core (not shown) is inserted into vent port 101. A suitable o-ring boss is then applied to cover off the vent port 101. An additional quantity of oil is then injected as "reserve" oil. The amount may vary depending on size and characteristics of the particular cushion unit 17 and its uses. In the one embodiment, with gas chamber 77 charged to 1900 psi, an additional quantity of oil increased the gas pressure to 2000 psi. The oil source is then removed and a suitable o-ring boss is attached to close off fill port 100. FIG. 6 shows a cushion unit 17 fully charged with its piston/rod 51 in the extended, rest position. In this rest position, the pressure in gas chamber 77 is approximately 2000 psi, and thus the pressure in outer and inner hydraulic chambers is also 2000 psi. The extra charge of oil after cushion unit 17 was already full raised outer piston 52 about ¼ inch above base plate 50.

Figure 7:
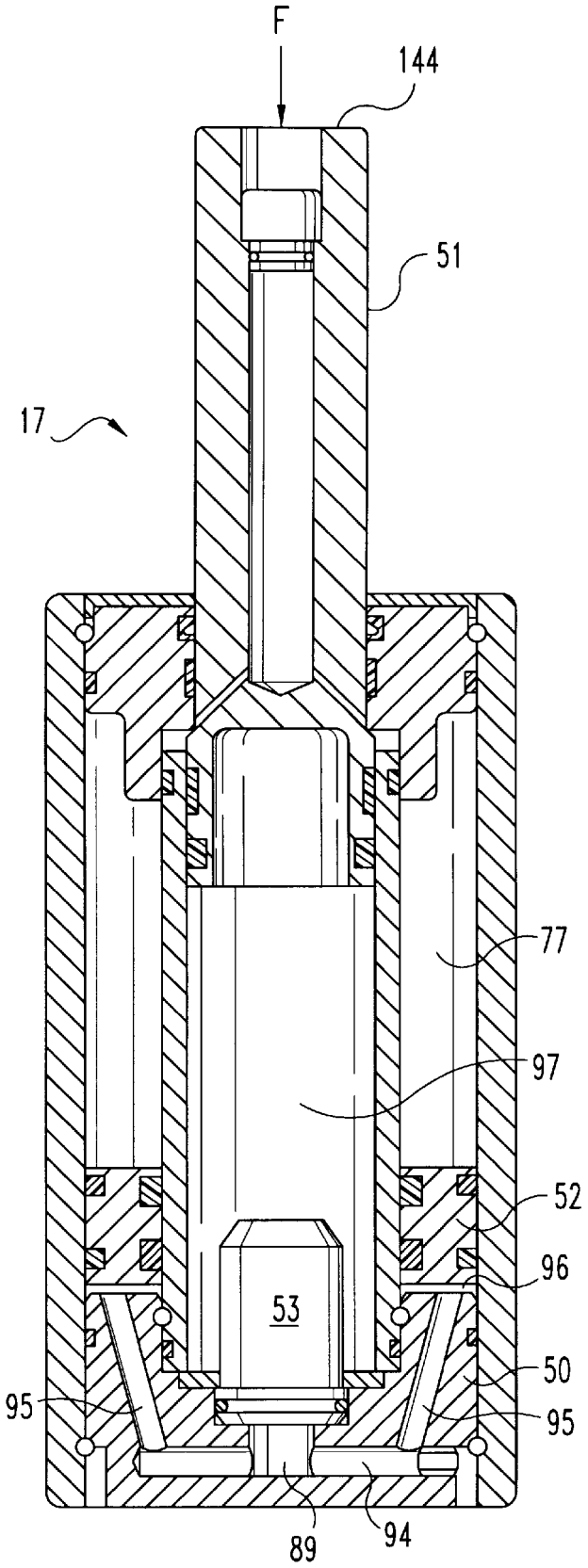
FIG. 7 is a side, cross-section view of cushion unit 17 of FIG. 3 showing piston/rod 51 in the extended, rest position.

In operation in the present embodiment, an input force F applied downwardly to the top 144 of piston/rod 51 meets a resistive force of approximately five tons. That is, such force F acts through piston/rod 51, through the incompressible oil in inner chamber 97, through check valve 53 (which does not inhibit flow from inner chamber 97 to outer chamber 96), through the incompressible oil in outer chamber 96, through outer piston 52 and against the gas at 2000 psi in chamber 77. Due to the surface areas of the piston faces in this embodiment, the 2000 psi pressure in chamber 77 translates to a five ton output resistive force back through piston/rod 51. Any applied force F (such as from the ram driven upper die 20) greater than five tons will overcome the resistive force and cause piston/rod 51 to move downwardly. As piston/rod 51 moves downwardly at the downstroke rate of upper die 20, oil is forced uninhibitedly through check valve 53 and into outer chamber 96, which causes outer piston 52 to rise, thus reducing the volume of gas chamber 77. As a result, the pressure of the nitrogen gas in chamber 77 increases. If the applied force F is great enough, piston/rod 51 will be driven to its retracted, compressed position shown in FIG. 3, whereupon the gas pressure in chamber 77 will rise to approximately 3060 psi, and outer piston will rise to the position shown in FIG. 3. The compression ratio of nitrogen gas volume rod "in" versus rod "out" is 1.53:1. That is, the ratio of pressures in gas chamber 77 when piston/rod 51 is in the extended, rest position and outer piston 52 is thus in the down position shown in FIG. 7 versus when piston/rod 51 is in the retracted, compressed position and outer piston 52 is thus in the up position shown in FIG. 3, is 1.53:1, in the present embodiment.

If the applied force F is suddenly removed, the 3060 psi gas pressure acts through piston 52 to urge oil to flow from outer chamber 96, through check valve 53 and into inner chamber 97. Because of the action of the Kepsel check valve 53 and the selected small orifice in the poppet valve (not shown), the flow of oil therethrough is severely restricted. In the present embodiment, an applied force F well in excess of five tons may drive piston/rod 51 down in a fraction of a second depending upon the press specifications. Upon an equally fast removal of such applied force F, check valve 53 acts to limit the return of oil from outer chamber 96 to inner chamber 97, and the resulting rise of piston/rod 51 from the compressed to extended positions shown, is the cushion unit upstroke rate and is held to about three seconds. This upstroke rate may be modified to suit the particular application of cushion unit 17.

Figure 8:
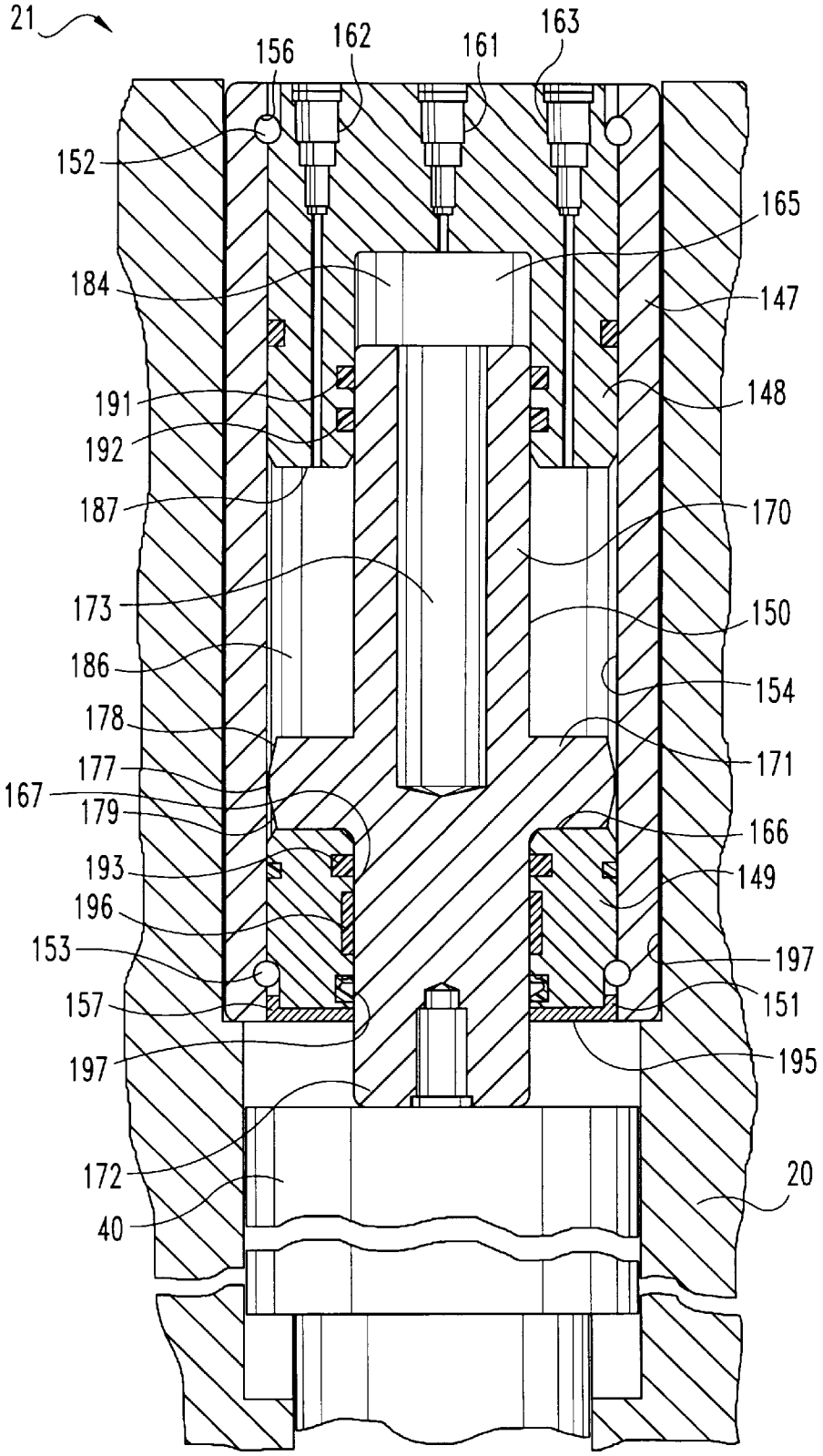
FIG. 8 is a side, cross-section view of shock absorber 21 of the press 10 in accordance with the preferred embodiment of the present invention, and shown with piston/rod 150 in the extended, rest position.

Referring now to FIG. 8, there is shown a hydraulic shock absorber 21 in accordance with the preferred embodiment of the present invention. Shock absorber 21 generally includes an outer tube 147, a head plate 148, a base plate 149, a piston and rod combination 150 (hereafter referred to as piston/rod 150), a rod end cover 151 and upper and lower lock rings 152 and 153, respectively. Like outer tube 47 of cushion unit 17, outer tube 147 is generally cylindrical, made of tool steel, defines an inner cylindrical wall 154, and has upper and lower outer, annular recesses 156 and 157 of circular cross-section to receive therein upper and lower lock rings 152 and 153, respectively. Head plate 148 is made of hardened tool steel and has a circular cross-section with an outer diameter substantially equal to the inner diameter of outer tube 147. Like head plate 49, head plate 148 defines an annular recess that is radiused at its bottom end to receive upper lock ring 152 therein. Head plate 148 further defines gas fill port 161, oil fill port 162 and vent port 163. Like gas fill port 75, oil fill port 100 and vent port 101, ports 161–163 are sized and configured to receive valve core members of any suitable type to provide valved injection and venting of gas and liquid into and out of the respective chambers. Head plate 148 also defines a central cavity 165 that is circular in cross-section and sized to receive a piston for reciprocation therein. Base plate 149 is made of hardened tool steel, has an outer diameter substantially equal to the inner diameter of outer tube 147 and has an annular shape with an upper surface 166 and an inner cylindrical surface 167. Like head plate 148, recess 157 of base plate 149 is radiused at its upper portion to receive lower lock ring 153 therein.

Piston/rod 150 is made of hardened tool steel and has an upper tubular piston portion 170, a central disc-shaped piston portion 171 and a lower piston rod portion 172. Upper tubular portion 170 has an outer diameter that is substantially equal to the diameter of cavity 165 of head plate 147. Upper tubular portion also defines a central cavity 173 that is in communication with cavity 165, as shown. The outer periphery of central disc-shaped piston portion 171 defines a central, cylindrically-shaped surface 177 and upper and lower frustoconically-shaped surfaces 178 and 179, respectively, the diameters of which decrease away from surface 177. The diameter of central, cylindrically-shaped surface 177 is selected specifically to be a certain amount less than the diameter of inner wall 154 of outer tube 147, the difference therebetween being directly related to the rate at which the hydraulic medium may flow under pressure from one side of piston portion 171 to the other between surfaces 177 and 154. In one embodiment, cylindrically-shaped surface 177 has an axial height of 0.2 inches and frustoconically-shaped surfaces 178 and 179 each have axially heights of 0.4 inches (the axial thickness of piston portion 171 thus being 1.0 inch), and the diameter of piston portion 171 is 3.9+/−0.000/0.001 inches and the diameter of inner wall 154 is 4.0+/−0.003/0.000 inches. It is an important object in the present embodiment to provide a gap between central surface 177 and inner wall 154 that is approximately 0.001 inches to provide a controlled metering of liquid from one liquid chamber to the other. Other embodiments are contemplated wherein the diameter of and shape of disc-shaped portion 171, including the shape of outer surfaces 177–179, may vary to achieve a desired flow rate or other desired operational characteristics. Piston rod portion 172 has an outer diameter that is substantially equal to the inner diameter of base plate 149.

Figure 9:
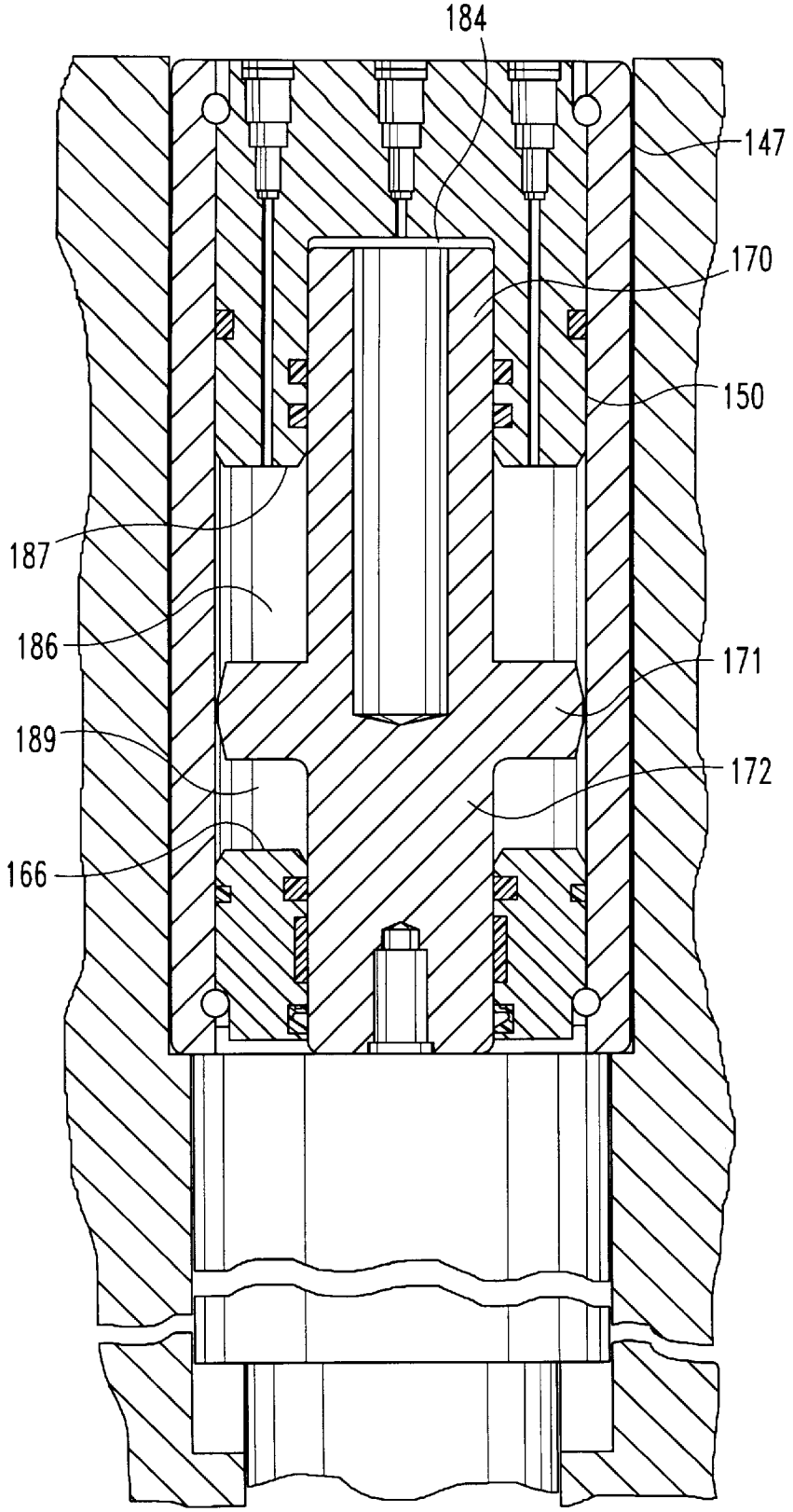
FIG. 9 is a side, cross-section view of shock absorber 21 of FIG. 7 showing piston/rod 150 in the compressed position.

Assembled as shown in FIGS. 8 and 9, shock absorber 21 defines three pressure chambers: gas chamber 184 essentially comprising cavities 165 and 173 and bounded by the inner surface of cavity 165, the top surface 185 of piston portion 170 and the inner surface of cavity 173; upper hydraulic chamber 186 bounded by piston portion 170, piston portion 171, outer tube 147 and the lower annular surface 187 of head plate 147; and, lower hydraulic chamber 189 bounded by piston rod portion 172, piston portion 171, outer tube 147 and the upper annular surface 166 of base plate 149. Seals 191 and 192 are mounted in recesses in head plate 147 to provide a seal between piston portion 170 and head plate 148, and specifically to prevent fluid leakage between gas chamber 184 and upper hydraulic chamber 186. Likewise, a seal 193 is mounted within a recess in base plate 149 to prevent leakage of fluid downwardly out of lower hydraulic chamber 189. As with head plate 49, a wear ring 196 and a rod wiper 197 are mounted within recesses in head plate 148 to center piston/rod 150 and prevent wear thereto and to keep foreign matter from entering lower hydraulic chamber 189 during reciprocation of piston/rod 150.

In assembly, gas chamber 184 is charged with nitrogen gas to a pressure of approximately 500 psi. This pressure may vary, but it should be enough to keep piston/rod 150 in the extended, rest position shown in FIG. 8, whereby piston rod portion extends approximately one inch down below lower surface 195 of shock absorber 21. Oil is then filled through oil fill port 162 with vent port 163 held open until all the air is out of both chambers 186 and 189.

Figure 10:
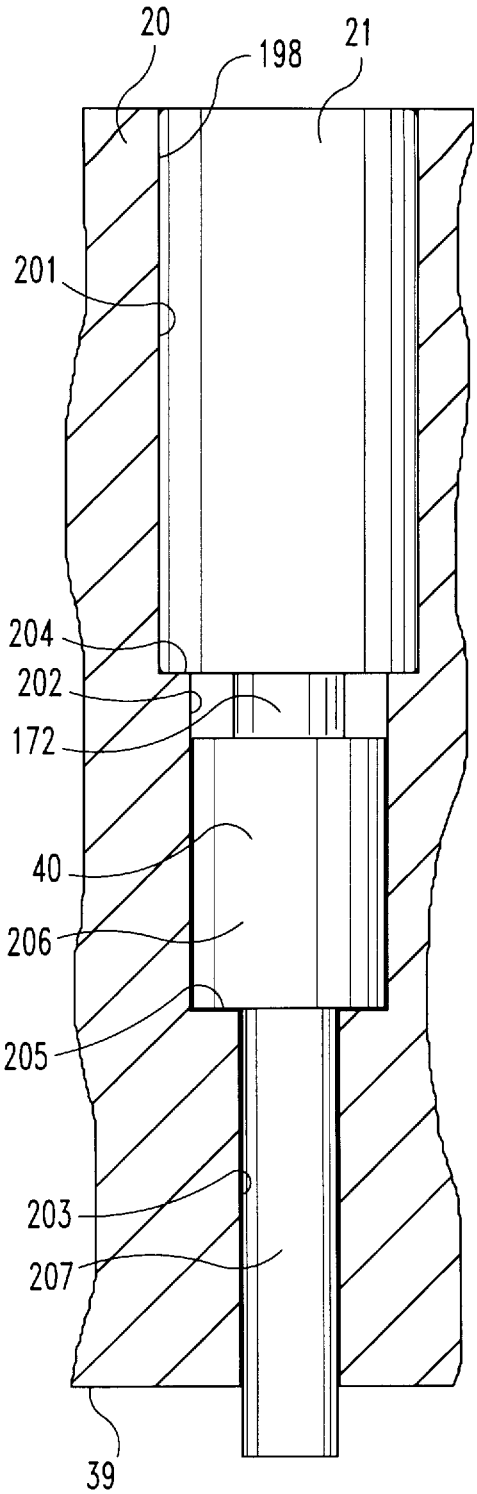
FIG. 10 is a side, partially cross-sectional view of shock absorber 21 mounted in upper die 20 and shown in the extended, rest position.
Figure 11:
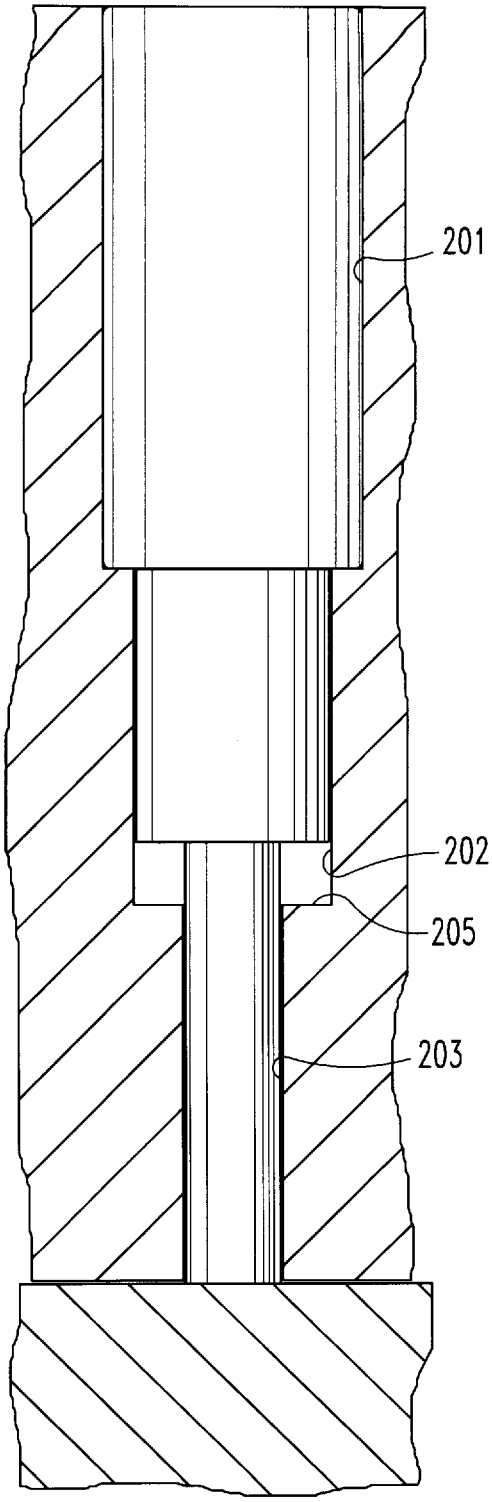
FIG. 11 is a side, partially cross-sectional view of shock absorber 21 mounted in upper die 20 and shown in the compressed position.

As described above and referring to FIGS. 10 and 11, a passageway 198 is defined down through upper die 20 and upper die shoe 18 (die 20 and upper die shoe may comprise a single unit as shown in FIGS. 9 and 10 and are referred to commonly thereat as upper die 20). Passageway 198 comprises upper, middle and lower sections 201, 202 and 203, respectively. The inner diameter of the upper section 201 is greater than that of middle section 202, thus creating an annular shoulder 204 therebetween. The inner diameter of middle section 202 is greater than the inner diameter of lower section 203, thus creating an annular shoulder 205 therebetween. The inner diameter of upper section 201 is slightly greater than the outer diameter of shock absorber 21. Plunger 40 has a large head 206 with a round cross-section and outer diameter that is slightly less than the inner diameter of middle section 202. Plunger 40 also has a rod 207 extending coaxially downwardly from head 206, and rod 207 has an outer diameter that is less than the inner diameter of lower section 203.

In use, plunger 40 is dropped down into passageway 198 where head 206 rests within middle section 202 atop shoulder 205, and rod 207 extends through lower section 203 and approximately one inch below lower planar surface 39 of upper die 20. Shock absorber 21 is then dropped down into passageway 198 where it rests within upper section 201 and atop shoulder 204, and wherein the downwardly extending piston rod portion 172 just touches head 206, as shown in FIG. 9. When die 20 is mounted to the underside of a ram (not shown), the top of passageway 198 is closed off, and shock absorber 21 and plunger 40 are securely housed within passageway 198. Plunger or adapter rod 40 may vary in length and is used to adapt shock absorber 21 for use with dies of varying thicknesses.

With press 10 in the open or top dead center position shown in the left half of FIG. 2, and with the 34, five ton cushion units 17 held in lower shoe 11 surrounding punch 12 as shown, and with the four shock absorbers 21 mounted to and in engagement with the corresponding plungers 40 which extend down one inch below lower planar surface 39 of upper die 20, and with a cushion 13 weighing approximately 6 tons and supported by four, 3 ton lift cylinders 15, press 10 operates as follows:

Upper die 20 is rammed down from top dead center toward the motionless cushion 13 at a downstroke rate The downstroke rate, and the ensuing upstroke rate, are typically a sinusoidal function of time, but may vary as desired. If the downstroke rate and upstroke rate are set at other than a sinusoidal rate, then the parameters of cushion units 17 and shock absorbers 21 should be modified appropriately to accomplish the cushioned action described herein. Plunger rods 207 engage the top 26 of cushion 13. The sudden input through rod 207 to piston/rod 150 causes piston/rod 150 to move upwardly within outer tube 147, but due to the very small gap between piston portion 171 and inner wall 154, telescopic movement of piston/rod 51 is not instantaneous, and therefore cushion 13 also begins to move. The parameters of shock absorbers 21 are chosen so that during the time it takes for piston/rod 51 to move the one inch from its extended, rest position (FIGS. 8 and 10) to its retracted, compressed position (FIGS. 9 and 11), cushion 13 has moved down only one inch. Restated, it is given that the rate of descent of die 20 stays substantially constant (unchanged from the contact with and resistance from cushion 13). When plunger rod 207 contacts cushion 13, die 20 continues to advance, but because of the metered hydraulic flow within shock absorber 21, piston/rod 150 takes X seconds to be compressed. By the time X seconds have elapsed, piston/rod 150 and plunger rod 207 have completely retracted, and lower planar surface 39 has essentially engaged upper surface 26, engaging and binding blank 33 therebetween. But also during that time X, cushion 13 has been moved downward one inch. Thus, while the downwardly charging upper die 20 has descended two inches, the six ton cushion, backed by the combined 12 ton lift cylinders 15 have only been moved one inch. The heretofore tremendous impact of the die 20 slamming into the motionless cushion and instantly accelerating it to the same speed as the die has been drastically reduced.

Upon descending one inch from its upper, rest position, cushion 13 has now engaged with the 34, five ton cushion units 17. Further descent of die 20 and cushion 13 will be with a combined compressive force between the two, roughly equal to the combined resistance of the four lift cylinders 15 (three tons each) and the 34 cushion units 17 (five tons each) or roughly 182 tons. With this compressive force, blank 33 is securely bound and it will be able to be drawn between punch 22 and cavity 37 as desired.

When die 20 and cushion 13 reach their nadir, the ram mechanism (not shown) reverses direction and lifts die 20 back up at a rate similar to its descent. Instead of cushion units 17 instantly following cushion 13, die 20 and the ram mechanics back up with their combined stored force which would exceed 170 tons, thus causing tremendous damage to the ram mechanics, check valve 53 retards the back flow of oil from outer chamber 96 to inner chamber 97 in each cushion unit 17. While it takes die 20 only about one second to return to top dead center, it takes each piston/rod 51 roughly three seconds to return to the extended rest position. Thus, cushion 13 separates at its bottom surface 27 from the piston/rods 51 substantially instantaneously upon the beginning of the press up-stroke.

Referring to FIG. 12, there is shown the lower portion of a cushion unit 210 in accordance with another embodiment of the present invention. In unit 210, the Kepner check valve 53 has been replaced by another check valve assembly comprising a check valve retainer plate 211, a frustoconically shaped poppet 212, a cylindrically shaped guide member 213 and a spring 214.

It is apparent from the description herein that cushion units 17 are self-contained. That is, cushion units 17 provide their cushioning and delay functions without reliance on any external pneumatic, hydraulic, electrical or other power source or cooling source connection. This is primarily because the ratio of the volume of working fluid versus the volume of the entire cushion unit apparatus provides a large heat sump and surface area for dissipation of heat. If desired, the exterior surface of outer tube 47 of cushion unit 17 may be erose. That is, the exterior surface may be made with ribs or a similar outwardly extending configuration to increase the surface area thereat, and therefore to increase the rate of heat transfer away from the cushion units. Such self-contained configuration permits a wide latitude in the use of the cushion units 17 without regard to design constraints relating to a power supply. Thus, just a few or many such cushion units 17 may be employed without running hydraulic lines or designing an elaborate hydraulic source, for example. Likewise, shock absorbers 21 provide a large heat sump and surface area for dissipation of heat and are self-contained, giving great latitude to the number used and their placement.

Alternative embodiments are contemplated wherein shock absorber 21 and cushion unit 17 are used in machines other than the press disclosed here. It is also contemplated that either shock absorber 21 or cushion unit 17 could be omitted from the press 10 or replaced by another device to provide an alternative operation. It is contemplated that either shock absorber 21 or cushion unit 17 could be inverted. That is, for example, cushion unit 17 could be constructed so that the piston/rod portion is mounted in stationary fashion to the shoe and the cylinder portion could be disposed to move upon direct or indirect engagement with the cushion. It is also contemplated that, like shock absorber 21, cushion unit 17 could be provided with a plunger or similar extension to transmit engagement with the cushion.

Embodiments are also contemplated which more or less cushion units 17 and more or less shock absorbers 21.

As used herein, the term "substantially identical" can mean equal to within less than a thousandth of an inch or less or can mean closely similar in size. The degree of similarity will be understood between such compared components to be whatever optimizes the performance of the correspondent part. Also, language is used to indicate structural and operational relationships. It is to be understood, however, that alternate configurations are contemplated as would occur to one skilled in the art. For example, "vertical" is used herein to describe reciprocation of pistons within the cushion unit when it is oriented as shown in the corresponding drawings. It is nevertheless understood that the cushion unit could operate along a horizontal axis, for example, and the piston action would consequently also be along the horizontal.

While the invention has been illustrated and described in detail in the drawings and foregoing description, the same is to be considered as illustrated and not restrictive in character, it being understood that only the preferred embodiment has been shown and described and that all changes and modifications that come within the spirit of the invention are desired to be protected.

What is claimed is:

1. A delayed return cushion unit, comprising:

an outer tube having an inner diameter and a top and a bottom;

a base plate disposed at the bottom of said tube;

an annular-shaped head plate disposed at the top of said tube and having an inner cylindrically-shaped wall;

an inner tube having in outer diameter and in inner diameter and mounted to extend between said head plate and said base plate within said outer tube;

an annular-shaped outer piston mounted between said inner and outer pistons to reciprocate between said head plate and said base plate;

an inner piston/rod mounted in said inner tube to reciprocate vertically therein between a retracted, compressed position and an extended, rest position, the rest position including said piston/rod extending through the inner cylindrically-shaped wall of said head plate and upwardly of said head plate;

wherein said outer tube, base plate, head plate, inner tube, outer piston and inner piston/rod define:

a gas chamber bounded by said outer tube, inner tube, head plate and outer piston, an outer hydraulic chamber bounded by said outer tube, inner tube, base plate and outer piston, and an inner hydraulic chamber bounded by said inner tube, base plate and inner piston/rod;

seal means for preventing leakage of gas from said gas chamber and hydraulic fluid from said hydraulic chambers;

passageway means providing communication between the outer hydraulic chamber and the inner hydraulic chamber and including a check valve permitting substantially unrestricted fluid flow from the inner hydraulic chamber to the outer hydraulic chamber, but severely restricting fluid flow from the outer hydraulic chamber to the inner hydraulic chamber;

gas in the gas chamber having a pressure greater than ambient pressure;

hydraulic fluid disposed in said inner and outer hydraulic chambers; and, means for retaining said head plate, base plate, inner tube, outer piston and inner piston/rod contained substantially entirely within said outer tube.

2. The delayed return cushion unit of claim 1 wherein the passageway means includes passageways defined within said base plate.

3. The delayed return cushion unit of claim 2 wherein said head plate, base plate, inner tube, outer piston, inner piston/rod and outer tube are substantially mutually coaxial.

4. The delayed return cushion unit of claim 3 wherein said base plate has a top surface which defines a first central recess and wherein the check valve is seated within the first central recess.

5. The delayed return cushion unit of claim 4 wherein the check valve has in inlet and an outlet and fluid flow is substantially uninhibited from the inlet to the outlet, and wherein the inlet is in communication with the inner hydraulic chamber and the outlet is in communication with the passageways of said base plate.

6. The delayed return cushion unit of claim 5 wherein said gas is nitrogen.

7. The delayed return cushion unit of claim 6 wherein said hydraulic fluid is oil.

8. The delayed return cushion unit of claim 6 wherein when said inner piston/rod is in its extended, rest position, said inner and outer hydraulic chambers are filled with oil and said nitrogen gas is charged to a pressure of approximately 2000 psi.

9. The delayed return cushion unit of claim 8 wherein said extended, rest position includes said piston/rod extending approximately six inches upwardly of said head plate.

10. The delayed return cushion unit of claim 9 wherein said base plate defines a second central recess coaxial with, outwardly of and above the first central recess, and wherein the delayed return cushion unit further includes an annular-shaped check valve retainer with an inner diameter and an outer diameter, the check valve retainer being mounted in the second central recess for holding the check valve securely in the first central recess.

11. The delayed return cushion unit of claim 10 wherein said base plate defines a third central recess coaxial with, outwardly of and above the second central recess, and wherein said inner tube is seated within the third central recess.

12. The delayed return cushion unit of claim 11 wherein the inner diameter of said inner tube is less than the outer diameter of the check valve retainer.

13. The delayed return cushion unit of claim 1 wherein said means for retaining includes:

said base plate having an axis and defining a pair of mutually parallel holes spaced equidistant from the axis, a central portion of said holes opening into the third recess, said inner tube having a top and a bottom and defining a pair of generally diametrically opposing, outer transverse recesses that are arcuate in cross-section and juxtaposed just above the bottom of said inner tube, and a pair of lock pins extending through the parallel holes and within the transverse recesses when said inner tube is seated within said base plate.

14. The delayed return cushion unit of claim 5 wherein said piston/rod has an upper piston rod portion and a lower piston portion, the lower piston portion having an outer diameter that is substantially equal to the inner diameter of said inner tube.

15. The delayed return cushion unit of claim 14 wherein the lower piston portion has a bottom and defines a downwardly opening inner cavity.

16. The delayed return cushion unit of claim 15 wherein the downwardly opening inner cavity of the lower piston portion is sized to receive a portion of said check valve extending upwardly therein.

17. The delayed return cushion unit of claim 1 wherein said cushion unit is self-contained.

18. A delayed return cushion unit, comprising:

an outer tube having a top and a bottom;

a base plate disposed at the bottom of said outer tube;

a head plate disposed at the bottom of said outer tube and having an opening;

an inner tube extending between said base plate and said head plate within said outer tube;

an outer piston mounted between said inner and outer tubes to reciprocate between said head plate and said base plate;

an inner piston/rod mounted in said inner tube to reciprocate between a retracted and an extended position, the extended position including a portion of said piston/rod extending through the opening and outwardly of said head plate;

wherein said outer tube, inner tube, head plate and outer piston define a gas chamber;

wherein said outer tube, inner tube, base plate and outer piston define an outer hydraulic chamber;

wherein said inner tube, base plate and inner piston/rod define an inner hydraulic chamber;

seal means for preventing undesired fluid flow from said chambers;

a check valve disposed between the inner and outer chambers for permitting substantially unrestricted fluid flow in one direction between the inner and outer chambers and for severely restricting fluid flow in an opposite direction between the inner and outer chambers;

gas in the gas chamber at a pressure above ambient pressure; and, hydraulic fluid in the inner and outer hydraulic chambers.

19. The delayed return cushion unit of claim 18 further including means for holding said head plate, base plate, inner tube, outer piston and inner piston/rod contained substantially entirely within said outer tube. valve.

20. The delayed return cushion unit of claim 18 further including passageway means providing communication between the hydraulic chambers and with said check.

21. The delayed return cushion unit of claim 20 wherein said passageway means includes passageways defined in said base plate.

22. The delayed return cushion unit of claim 19 wherein said inner and outer tubes are generally cylindrical and wherein said head plate is generally annular with the opening in said head plate being generally cylindrical.

23. The delayed return cushion unit of claim 18 wherein said base plate has a top surface which defines a first central recess and wherein said check valve is seated within the recess.

24. The delayed return cushion unit of claim 23 wherein the check valve has in inlet and an outlet and fluid flow is substantially uninhibited from the inlet to the outlet, and wherein the inlet is in communication with the inner hydraulic chamber and the outlet is in communication with the passageways of said base plate.

25. The delayed return cushion unit of claim 18 wherein said gas is nitrogen.

26. The delayed return cushion unit of claim 18 wherein said hydraulic fluid is oil.

27. The delayed return cushion unit of claim 18 wherein the extended position includes the inner and outer hydraulic chambers being filled with oil and the gas chamber being filled with nitrogen gas to a pressure of approximately 2000 psi.

28. The delayed return cushion unit of claim 27 wherein the retracted position includes said inner and outer hydraulic chambers being filled with oil and the gas chamber being filled with nitrogen gas to a pressure of approximately 3060 psi.

29. The delayed return cushion unit of claim 28 wherein said extended position includes said piston/rod extending approximately six inches further outwardly of said head plate than when in said retracted position.

30. The delayed return cushion unit of claim 23 wherein said base plate defines a second central recess coaxial with, outwardly of and above the first central recess, and wherein the delayed return cushion unit further includes an annular-shaped check valve retainer with an inner diameter and an outer diameter, the check valve retainer being mounted in the second central recess for holding the check valve securely in the first central recess.

31. The delayed return cushion unit of claim 30 wherein said base plate defines a third central recess coaxial with, outwardly of and above the second central recess, and wherein said inner tube is seated within the third central recess.

32. The delayed return cushion unit of claim 31 wherein said inner tube has an inner diameter that is less than the outer diameter of the check valve retainer.

33. The delayed return cushion unit of claim 32 further including means for holding said head plate, base plate, inner tube, outer piston and inner piston/rod contained substantially entirely within said outer tube, said holding means including:

said base plate having an axis and defining a pair of holes spaced oppositely of said axis, a central portion of said holes opening into the third recess, said inner tube having a top and a bottom and defining a pair of opposing, outer transverse openings that are juxtaposed just above the bottom of said inner tube, and a pair of lock pins extending through the parallel holes and through the transverse openings when said inner tube is seated within said base plate.

34. The delayed return cushion unit of claim 18 wherein said piston/rod has an upper piston rod portion and a lower piston portion, the lower piston portion having an outer diameter that is substantially equal to the inner diameter of said inner tube.

35. The delayed return cushion unit of claim 34 wherein the lower piston portion has a bottom and defines a downwardly opening inner cavity.

36. The delayed return cushion unit of claim 35 wherein the downwardly opening inner cavity of the lower piston portion is sized to receive a portion of said check valve extending upwardly therein.

37. The delayed return cushion unit of claim 18 wherein said cushion unit is self-contained.

* * * * *